US009739089B2

(12) United States Patent
Smith

(10) Patent No.: US 9,739,089 B2
(45) Date of Patent: Aug. 22, 2017

(54) COVERING FOR AN ARCHITECTURAL OPENING

(71) Applicant: Hunter Douglas Inc., Pearl River, NY (US)

(72) Inventor: Stephen P. Smith, Denver, CO (US)

(73) Assignee: HUNTER DOUGLAS INC., Pearl River, NY (US)

( * ) Notice: Subject to any disclaimer, the term of this patent is extended or adjusted under 35 U.S.C. 154(b) by 0 days.

(21) Appl. No.: 14/770,204

(22) PCT Filed: Mar. 11, 2013

(86) PCT No.: PCT/US2013/030223

§ 371 (c)(1),
(2) Date: Aug. 25, 2015

(87) PCT Pub. No.: WO2014/142790

PCT Pub. Date: Sep. 18, 2014

(65) Prior Publication Data

US 2016/0010390 A1 Jan. 14, 2016

(51) Int. Cl.

| | |
|---|---|
| ***E06B 9/60*** | (2006.01) |
| ***E06B 9/42*** | (2006.01) |
| ***E06B 9/78*** | (2006.01) |
| ***E06B 9/32*** | (2006.01) |
| *E06B 9/24* | (2006.01) |
| *E06B 9/262* | (2006.01) |

(Continued)

(52) U.S. Cl.

CPC ..... *E06B 9/60* (2013.01); *E06B 9/262* (2013.01); *E06B 9/32* (2013.01); *E06B 9/42* (2013.01); *E06B 9/78* (2013.01); *E06B 2009/2435* (2013.01); *E06B 2009/2627* (2013.01); *E06B 2009/583* (2013.01); *E06B 2009/801* (2013.01); *E06B 2009/807* (2013.01)

(58) Field of Classification Search

CPC ..... E06B 9/60; E06B 2009/2435; E06B 9/44; E06B 2009/445; E06B 9/46; E06B 9/48; E06B 9/50; E06B 9/88; E06B 9/34; E06B 9/40; E06B 9/42; E06B 9/17; E06B 9/56

USPC ..... 160/313, 296

See application file for complete search history.

(56) References Cited

U.S. PATENT DOCUMENTS

| | | | | |
|---|---|---|---|---|
| 5,628,356 | A | 5/1997 | Marocco | |
| 7,380,582 | B1 * | 6/2008 | Anderson | E06B 9/34 160/323.1 |
| 2006/0118248 | A1 | 6/2006 | Anderson et al. | |

(Continued)

OTHER PUBLICATIONS

PCT International Search Report and Written Opinion dated May 24, 2013 for International Application No. PCT/US2013/030223, 9 pages.

*Primary Examiner* — Blair M Johnson
*Assistant Examiner* — Jeremy Ramsey
(74) *Attorney, Agent, or Firm* — Fox Rothschild LLP

(57) ABSTRACT

A covering for an architectural opening is provided. The covering may include a roller, a shade, and an assembly associated with the roller. The assembly may include a biasing element and a retention element. The biasing element may be operably associated with the roller to selectively rotate the roller. The biasing element may be preloaded. The retention element may be associated with the biasing element. The retention element may be operable to release the preload in the biasing element at an extended shade position.

28 Claims, 15 Drawing Sheets

(51) Int. Cl.
*E06B 9/58* (2006.01)
*E06B 9/80* (2006.01)

(56) References Cited

U.S. PATENT DOCUMENTS

| | | | | |
|---|---|---|---|---|
| 2008/0202709 | A1 | 8/2008 | Anderson et al. | |
| 2012/0048485 | A1 | 3/2012 | Fu-Lai et al. | |
| 2014/0216666 | A1* | 8/2014 | Smith | E06B 9/38<br>160/84.04 |
| 2015/0368966 | A1* | 12/2015 | Faller | E06B 9/58<br>160/311 |
| 2015/0368969 | A1* | 12/2015 | Lin | E06B 9/76<br>242/395 |
| 2015/0376941 | A1* | 12/2015 | Fujita | E06B 9/26<br>160/241 |

* cited by examiner

COVERING FOR AN ARCHITECTURAL OPENING

CROSS-REFERENCE TO RELATED APPLICATION

This application is the national stage application of International Patent Application No. PCT/US2013/030223, filed Mar. 11, 2013, entitled "Covering For an Architectural Opening", which is hereby incorporated by reference herein in its entirety for all purposes.

FIELD

The present disclosure relates generally to coverings for architectural openings, and more particularly to apparatus and methods for operating a covering for an architectural opening.

BACKGROUND

Coverings for architectural openings, such as windows, doors, archways, and the like, have taken numerous forms for many years. Some coverings include a retractable shade that is movable between an extended position and a retracted position. In the extended position, the shade of the covering may be positioned across the opening. In the retracted position, the shade of the covering may be positioned adjacent one or more sides of the opening.

Some coverings include a shade that is lowered by gravity. For some types of gravity-lowered shades, once released, the shade may extend into an operational position without further action by the operator. However, for certain types of coverings, such as shades with operable vanes that open when fully lowered, gravity alone may be insufficient to fully lower the shade. Inconveniently, once the gravity-driven lowering is completed, the operator may have to interact with the covering to fully extend the shade into a desired operational position.

SUMMARY

Examples of the disclosure may include a covering for an architectural opening. The covering may include a roller, a shade, and an assembly associated with the roller. The assembly may include a biasing element and a retention element. The biasing element may be operably associated with the roller to selectively rotate the roller in an extension direction. The biasing element may be preloaded. The retention element may be associated with the biasing element. The retention element may be operable to release the preload in the biasing element at an extended shade position.

In another example, the covering may include a rotatable roller, a shade suspended from the roller and wrappable about the roller, and an assembly associated with the roller. The assembly may rotate the roller a supplemental amount in an extension direction when the shade is in an extended position. The assembly may include an anchor, a preloaded biasing element having a fixed end and a movable end, and a pawl associated with the movable end of the preloaded biasing element. The pawl may be movable between a first position and a second position. When in the first position, the pawl may engage the anchor to restrict movement of the movable end of the preloaded biasing element. When in the second position, the pawl may disengage the anchor to free the movable end of the preloaded biasing element, which may rotate the roller the supplemental amount in the extension direction.

In a further example, the covering may include a rotatable roller, a shade associated with the roller so that rotation of the roller in one direction retracts the shade and rotation of the roller in an opposite direction extends the shade, and an assembly associated with the roller to selectively rotate the roller in the opposite direction. The assembly may include a rotatably fixed anchor, a preloaded torsion spring having a fixed end and a movable end, a shaft having a first section and a second section, and a pawl. The first section of the shaft may be rotatably mounted on the anchor and may include a cavity open to the anchor and to the roller. The second section of the shaft may be secured to the movable end of the preloaded torsion spring. The pawl may be pivotably seated in the cavity and may be pivotable between a radially-inward position and a radially-outward position. When in the radially-inward position, the pawl may engage the anchor to limit rotation of the movable end of the preloaded torsion spring. When in the radially-outward position, the pawl may disengage the anchor and engage the roller to rotate the roller in the opposite direction under the bias of the preloaded torsion spring.

This summary of the disclosure is given to aid understanding, and one of skill in the art will understand that each of the various aspects and features of the disclosure may advantageously be used separately in some instances, or in combination with other aspects and features of the disclosure in other instances. Accordingly, while the disclosure is presented in terms of examples, it should be appreciated that individual aspects of any example can be claimed separately or in combination with aspects and features of that example or any other example.

This summary is neither intended nor should it be construed as being representative of the full extent and scope of the present disclosure. The present disclosure is set forth in various levels of detail in this application and no limitation as to the scope of the claimed subject matter is intended by either the inclusion or non-inclusion of elements, components, or the like in this summary. Moreover, reference made herein to "the present invention" or aspects thereof should be understood to mean certain examples of the present disclosure and should not necessarily be construed as limiting all examples to a particular description.

BRIEF DESCRIPTION OF THE DRAWINGS

The accompanying drawings, which are incorporated in and constitute a part of the specification, illustrate examples of the disclosure and, together with the general description given above and the detailed description given below, serve to explain the principles of these examples.

Figure 1:
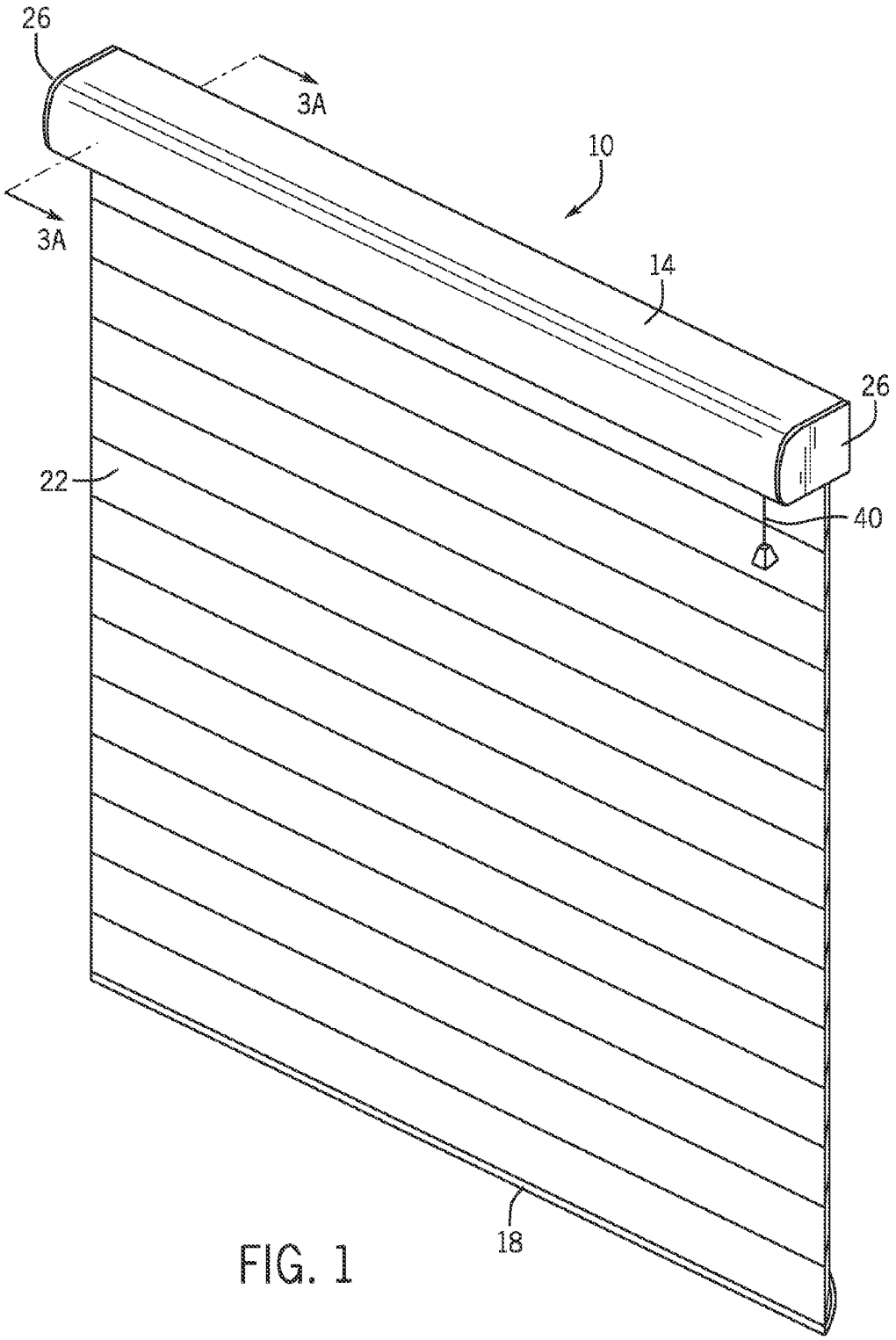
FIG. 1 is an isometric view of a covering with a shade in a partially-extended position.

It should be understood that the drawings are not necessarily to scale. In certain instances, details that are not necessary for an understanding of the disclosure or that render other details difficult to perceive may have been omitted. In the appended drawings, similar components and/or features may have the same reference label. Further, various components of the same type may be distinguished by following the reference label by a letter that distinguishes among the similar components. If only the first reference label is used in the specification, the description is applicable to any one of the similar components having the same first reference label irrespective of the second reference label. It should be understood that the claimed subject matter is not necessarily limited to the particular examples or arrangements illustrated herein.

DETAILED DESCRIPTION

The present disclosure provides a covering for an architectural opening. The covering may include a rotatable roller and an assembly positioned at least partially within the roller. The assembly may support an end of the roller and may be associated with an end of a head rail. The assembly may be configured to store potential energy and to release that energy in the form of kinetic energy at a specific shade position during extension of the shade. The kinetic energy may rotate the roller in a specific direction to effect full extension of the shade.

The assembly may include an anchor, a biasing element, and a retention element. The anchor may be fixed in space, such as axially and/or rotatably fixed. The biasing element may be preloaded with a resilient force and may remain in a preloaded state until the shade reaches a predetermined extended position. The biasing element may be an elastic member (such as a compression, extension, or torsion spring) or any other suitable energy storage member. The predetermined extended position of the shade may be associated with a final revolution of the roller in which further rotation of the roller repositions at least a portion of the shade from one side of the roller (e.g., a front side) to an opposite side of the roller (e.g., a back side). For example, further rotation of the roller may laterally separate a Silhouette® shade.

The retention element may be configured to retain the potential energy or preload in the biasing element until the shade reaches a predetermined extended position. The retention element may be selectively associated with the anchor to either restrict or permit movement of the biasing element. When associated with the anchor, the retention element may restrict movement of the biasing element, thereby maintaining the preload in the biasing element. When not associated with the anchor, the retention element may permit movement of the biasing element, thereby enabling conversion of the stored potential energy into kinetic energy, which may effect rotation of the roller and a full extension of the shade.

The retention element may be movable between a first position and a second position. For instance, the retention element may be slidable, pivotable, and/or rotatable between the first and second positions. Movement of the retention element into the first position may interconnect the biasing element and the anchor. Movement of the retention element into the second position may disconnect the biasing element from the anchor. The first and second positions of the retention element may be axially spaced, circumferentially spaced, radially spaced, or any combination thereof.

Once released, the potential energy or preload of the biasing element may be restored during normal shade operation. For instance, during retraction of the shade, the roller may effect movement of the retention element, which in turn may effect movement of the biasing element in a preloading direction. Once a desired preload is achieved, the retention element may move into the first position to maintain the preload in the biasing element for use during the next shade operating cycle. When in the first position, the retention element may be positioned so as to not interfere with shade operation. As such, a covering is provided that includes a shade that may be repeatedly lowered via gravity into a fully operational position in a continuous, uninterrupted, smooth action without operator intervention.

Figure 2:
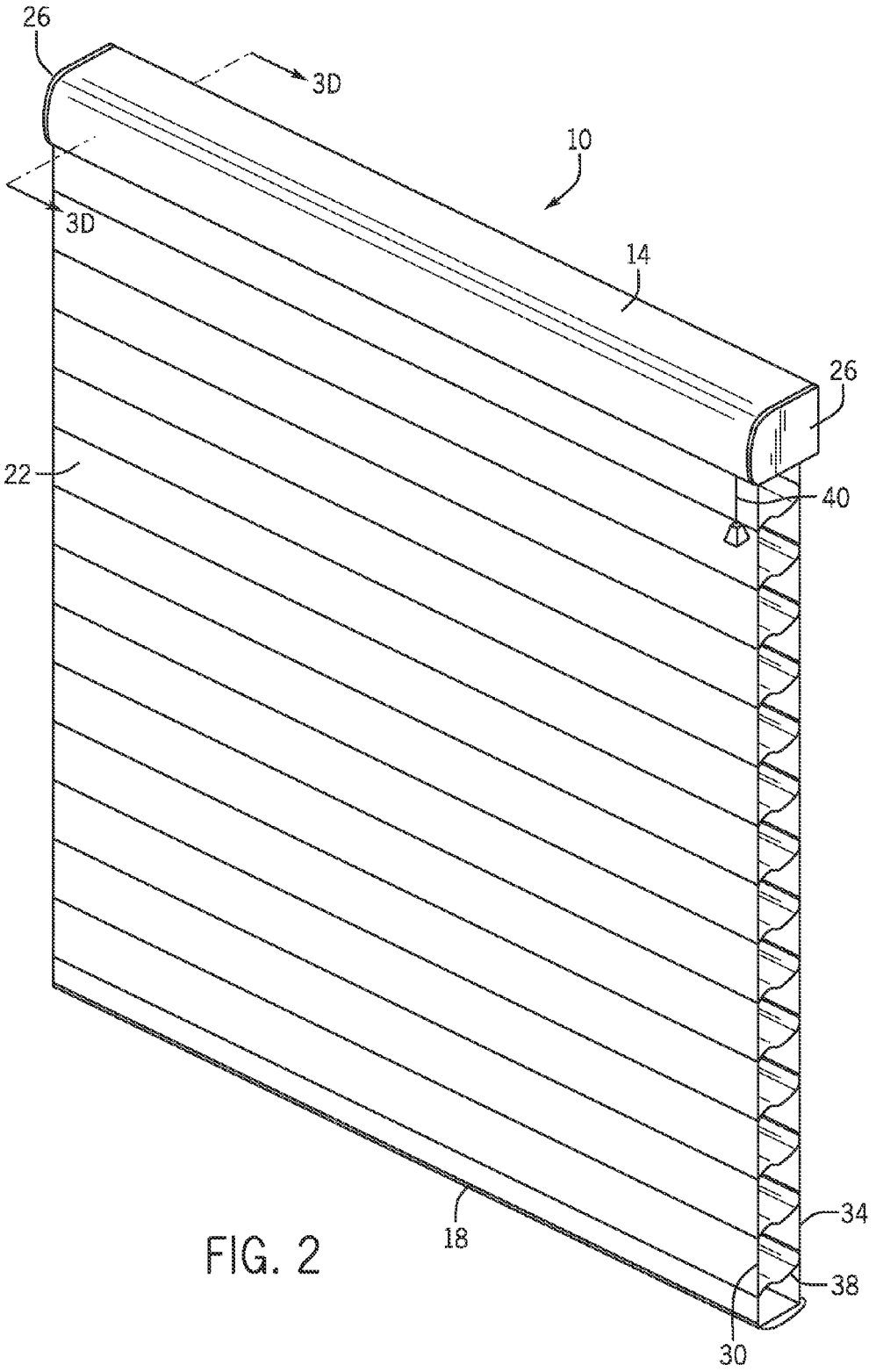
FIG. 2 is an isometric view of the covering of FIG. 1 with the shade in a fully-extended position.

Referring to FIGS. 1 and 2, a retractable covering 10 for an architectural opening is provided. The retractable covering 10 includes a head rail 14, a bottom rail 18, and a shade extending between the head rail 14 and the bottom rail 18. The head rail 14 includes two opposing end caps 26, which may enclose the ends of the head rail 14 to provide a finished appearance. The bottom rail 18 may extend horizontally along a lower edge of the shade 22 and may function as a balast to maintain the shade 22 in a taut condition and to aid in a gravity-driven extension of the shade 22.

The shade 22 may include vertically suspended front 30 and rear 34 sheets of flexible material (such as sheer fabric) and a plurality of horizontally-extending, vertically-spaced flexible vanes 38. Each of the vanes 38 may be secured along horizontal lines of attachment with a front edge attached to the front sheet 30 and a rear edge attached to the rear sheet 34. The sheets 30, 34 and vanes 38 may form a plurality of elongated, vertically-aligned, longitudinally-extending, transversely-collapsible cellular units which are longitudinally secured, such as adhered, to adjacent cellular units to define a vertical stack of cellular units, which may be referred to as a cellular panel. The sheets 30, 34 and/or the vanes 38 may be constructed of continuous lengths of material or may be constructed of strips of material attached or joined together in an edge-to-edge, overlapping, or other suitable relationship.

The shade 22 may be constructed of substantially any type of material. For example, the shade 22 may be constructed from natural and/or synthetic materials, including fabrics, polymers, and/or other suitable materials. Fabric materials may include woven, non-woven, knits, or other suitable fabric types. The shade 22 may have any suitable level of light transmissivity. For example, the shade 22, including the sheets 30, 34 and/or the vanes 38, may be constructed of transparent, translucent, and/or opaque materials to provide a desired ambience or décor in an associated room. In one example, the sheets 30, 34 are transparent and/or translucent, and the vanes 38 are translucent and/or opaque.

The covering 10 may include a drive mechanism configured to raise or retract the shade 22. The drive mechanism may include a crank, an electrical motor, a spring, an operating element 40 (such as a cord or ball chain) operably coupled to a pulley, or any other suitable drive element or mechanism. If the covering 10 is motorized, the covering 10 may include a receiver operable to communicate with a transmitter, such as a remote control unit. As such, the covering 10 may be operated mechanically and/or electrically.

Still referring to FIGS. 1 and 2, the covering 10 is shown with the shade 22 in two different extended positions. FIG. 1 depicts the shade 22 in a partially extended position in which further rotation of the roller 42 in an extending direction moves the front and rear sheets 30, 34 generally vertically (relative to each other) to shift the vanes 38 between open and closed positions. When in the closed or collapsed position of FIG. 1, the front and rear sheets 30, 34 are relatively close together and the vanes 38 extend vertically in an approximately coplanar, contiguous relationship with the front and rear sheets 30, 34. FIG. 2 depicts the shade 22 in a fully extended position with the vanes 38 in an open or expanded position. In this position, the front and rear sheets 30, 34 are horizontally spaced with the vanes 38 extending substantially horizontally therebetween.

Figure 3A:
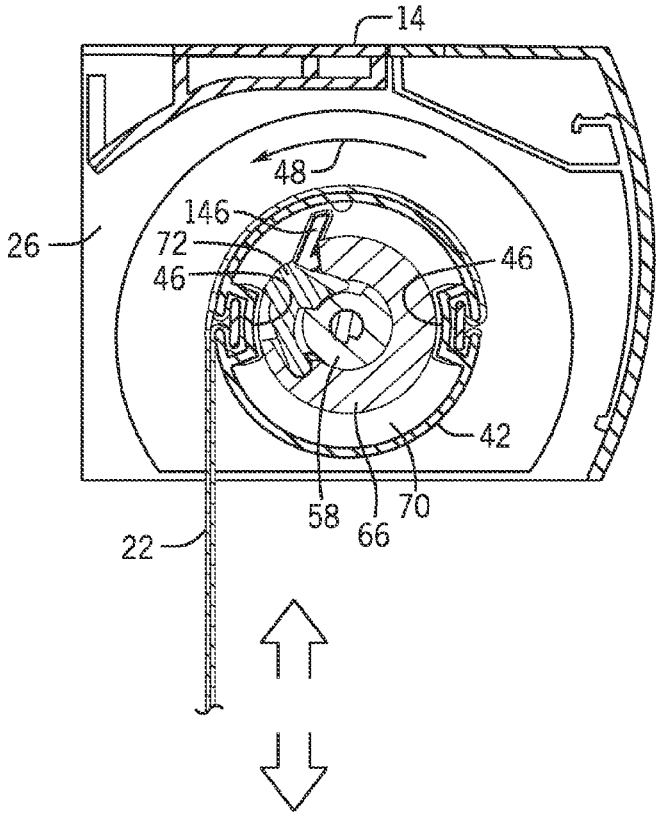
FIGS. 3A, 3B, 3C, and 3D are section views of the covering of FIG. 1 with a roller positioned one-half revolution from a fully-extended position, one-quarter revolution from a fully-extended position, one-eighth revolution from a fully-extended position, and in a fully-extended position, respectively.
Figure 3B:
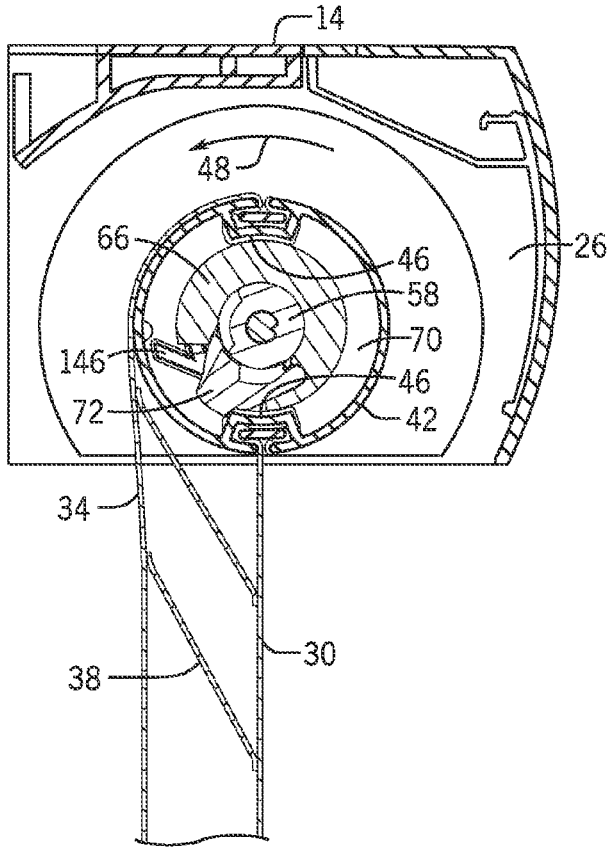
Figure 3C:
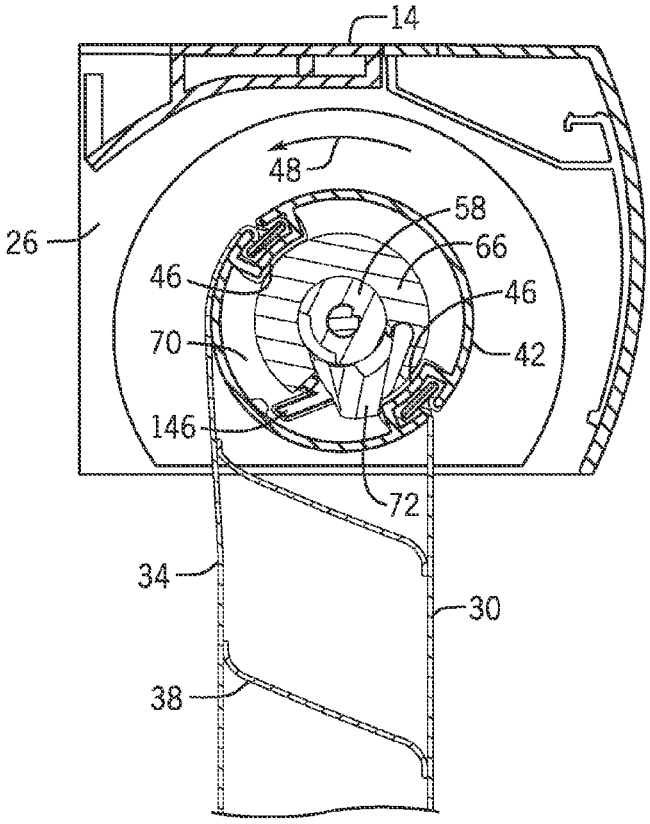
Figure 3D:
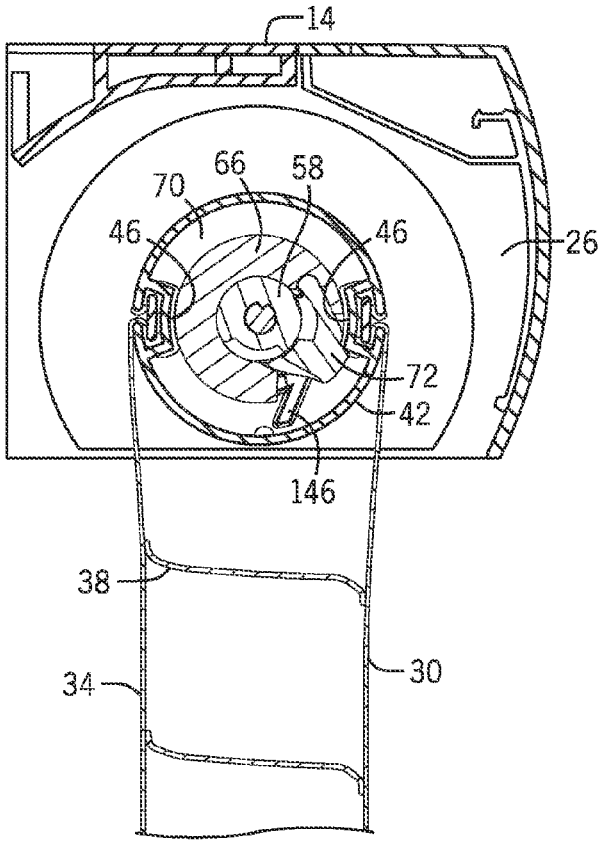

With reference to FIG. 3A, the shade 22 may be operably associated with a roller 42 so that rotational movement of the roller 42 about a longitudinally-extending axis moves the shade 22 between extended and retracted positions. For instance, the shade 22 may be coupled to and wrappable about the roller 42 so that rotation of the roller 42 in a first direction may retract the shade 22 to a position adjacent one or more sides of an associated architectural opening and rotation of the roller 42 in a second, opposite direction may extend the shade 22 across the opening. As shown in FIGS. 3A-3D, the shade 22 may be wrapped about or unwrapped from a rear side of the roller 42, with the rear side of the roller 42 positioned between a front side of the roller 42 and a street side of an associated architectural opening. Alternatively, the shade 22 may be wrapped about or unwrapped from the front side of the roller 42. As also shown in FIGS. 3A-3D, an upper edge of each of the front and rear sheets 30, 34 may be coupled to an inwardly-directed, longitudinally extending gland or rib 46. The gland 46 may define an internal cavity that opens through a periphery of the roller 42.

To move the shade 22, an operator may manipulate an operating element 40 (see FIGS. 1 and 2). For example, to raise or retract the shade 22 from an extended position, the operator may pull the operating element 40 downward in short, reciprocating strokes. To extend or lower the shade 22 from a retracted position, the operator may manipulate the operating element 40 to release a brake, which may allow the shade to automatically lower under the influence of gravity. Alternatively, the operating element 40 may be replaced with an electric motor configured to extend or retract the shade 22 upon receiving an extension or retraction command. The motor may include a gravity lower state to permit the shade 22 to lower via gravity without motor intervention, thereby reducing power consumption. The covering 10 may include a speed governing device to control or regulate the extension or lowering speed of the shade 22.

For certain types of shades, such as the Silhouette® shade shown in FIGS. 1-3, gravity alone may be insufficient to fully actuate or open the shade 22. As shown in FIGS. 3A-3D, during a final one-half revolution of the roller 42 in a shade extension direction 48, the roller 42 separates the front and rear sheets 30, 34, lifts the front sheet 30, and lifts a front-side of the vanes 38 to a horizontal orientation. At least a portion of the movement of the front sheet 30 and the vanes 38 opposes gravity, and thus in many circumstances the shade 22 will not fully open via gravity. Similarly, gravity alone may be insufficient to fully extend other types of shades. For example, some shades wrap around and unwrap from a front side of the roller 42. For these types of shades, a final one-quarter revolution of the roller 42 rotates the shade 22 from a bottom-dead center location toward the architectural opening, such as a window, in which the shade 22 is raised relative to the bottom-dead center location. The arcuate motion of the shade 22 during this final one-quarter revolution of the roller 42 works against gravity and thus rotational assistance may be needed to overcome the downward gravitational force.

Figure 4:
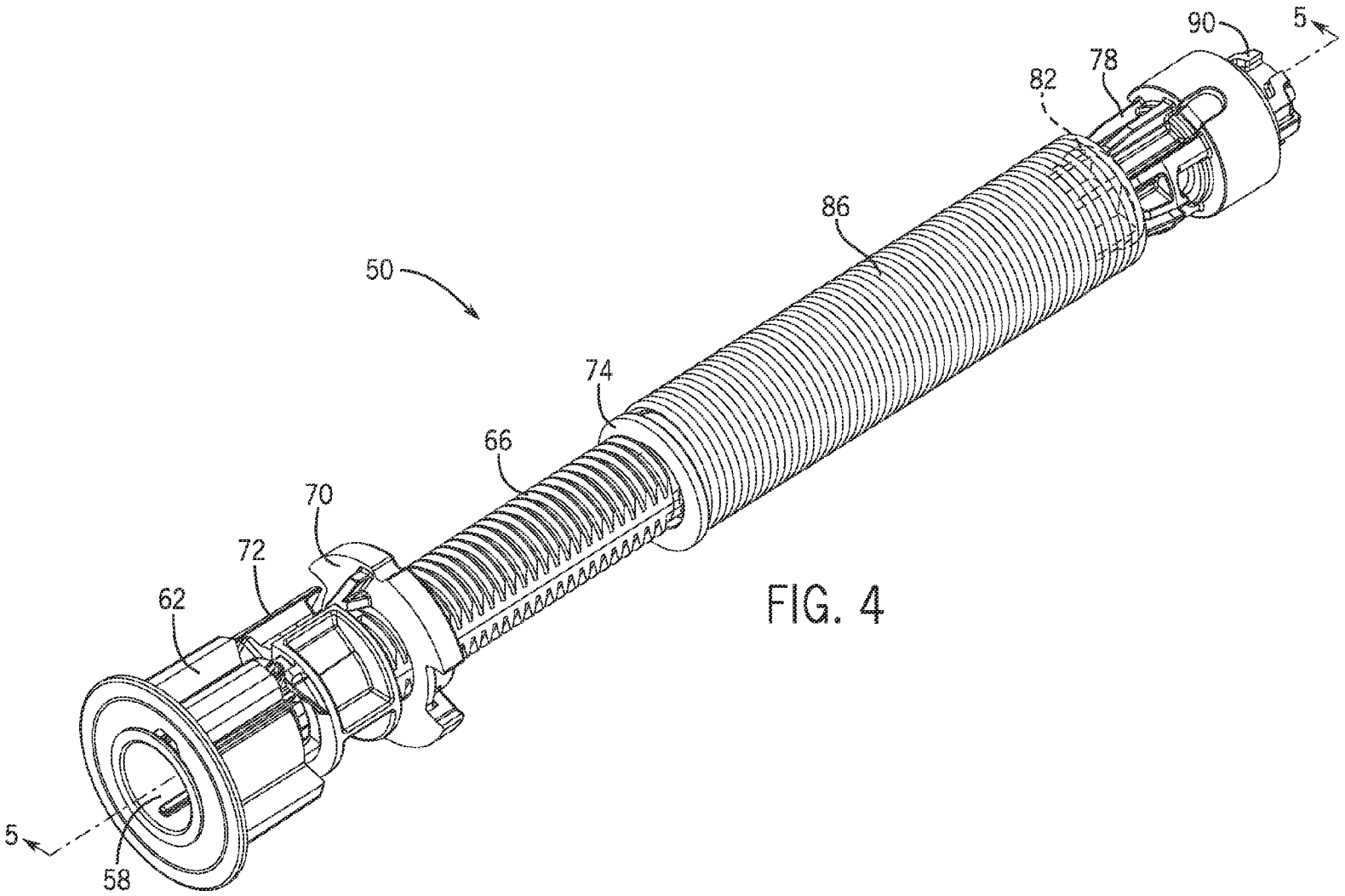
FIG. 4 is an isometric view of a supplemental revolution assembly.
Figure 5:
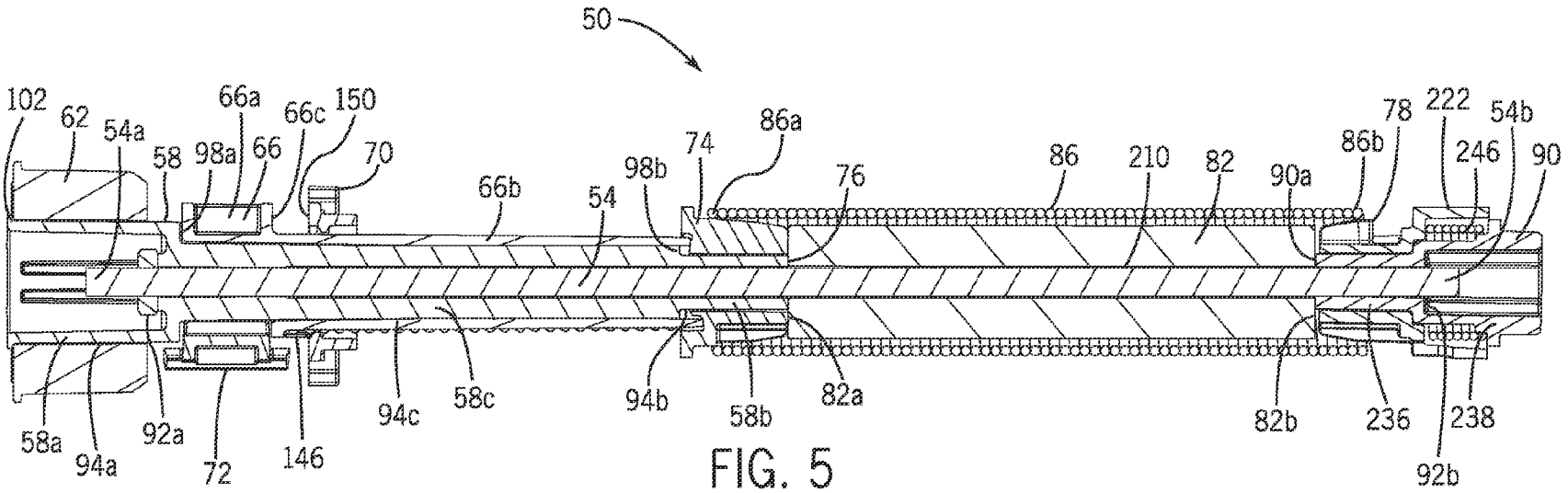
FIG. 5 is a lengthwise section view of the supplemental revolution assembly of FIG. 4 taken along line 5-5 as shown in FIG. 4.

With reference to FIGS. 4 and 5, the covering 10 may include a supplemental revolution assembly 50. The supplemental revolution assembly 50 may be assembled as a single, modular unit that couples to one end of the head rail 14, supports an end of the roller 42, and extends at least partially into an interior space of the roller 42. The supplemental revolution assembly 50 (which may be referred to as a module, system, or unit) may be pre-assembled and thus simplify on-site assembly of the covering 10. The supplemental revolution assembly 50 may be added to existing coverings 10 (i.e., retrofit).

With continued reference to FIGS. 4 and 5, the supplemental revolution assembly 50 is shown in an assembled configuration. As shown, the supplemental revolution assembly 50 may be aligned along a common longitudinal axis, which may be co-axial with a central axis of the roller 42. The supplemental revolution assembly 50 may be configured to rotate the roller 42 a specific amount (such as a final one-eighth revolution, one-quarter revolution, one-half revolution, amounts therebetween, or other suitable amounts) as the shade 22 approaches a fully extended position.

As shown in FIGS. 5 and 6, the supplemental revolution assembly 50 may include a non-rotatable central axle 54, a non-rotatable anchor 58, a rotatable bearing 62, a rotatable shaft 66, a travelable nut 70, a pivotable pawl 72, a rotatable spring fitting 74, a non-rotatable spring fitting 78, a spacer 82, a torsion spring 86, and a non-rotatable distal coupler 90. With specific reference to FIG. 5, the axle 54 may extend through a central bore of the supplemental revolution assembly 50 and may include a proximal end 54*a* and a distal end 54*b*. A fastener 92*a*, 92*b* may be removably associated with each end 54*a*, 54*b*, respectively, of the central axle 54 to axially secure the supplemental revolution assembly 50 together. The terms proximal and distal are used herein relative to an associated end cap 26, with a proximal feature being closer to the associated end cap 26 than a distal feature. The usage of the terms proximal and distal will follow this convention throughout this disclosure unless otherwise noted.

The anchor 58 may interconnect the central axle 54 and one of the end caps 26. For instance, the anchor 58 may be keyed to one of the end caps 26 and to the proximal end 54*a* of the axle 54 to prevent relative rotation between the anchor 58, the respective end cap 26, and the axle 54. In other words, the anchor 58 and the axle 54 may be rotatably fixed to one of the end caps 26 when the supplemental revolution assembly 50 is associated with the covering 10.

With reference to FIGS. 4, 5, 6A, and 6B, the non-rotatable anchor 58 may include a proximal section 58*a*, a distal section 58*b*, and an intermediate section 58*c* interconnecting the proximal and distal sections 58*a*, 58*b*. The proximal section 58*a* may be configured for attachment to an end cap 26. For example, the proximal section 58*a* may include circumferentially-spaced, internal splines configured to engage corresponding circumferentially-spaced grooves formed in the end cap 26, thereby preventing relative rotation between the anchor 58 and the end cap 26.

Figure 6A:
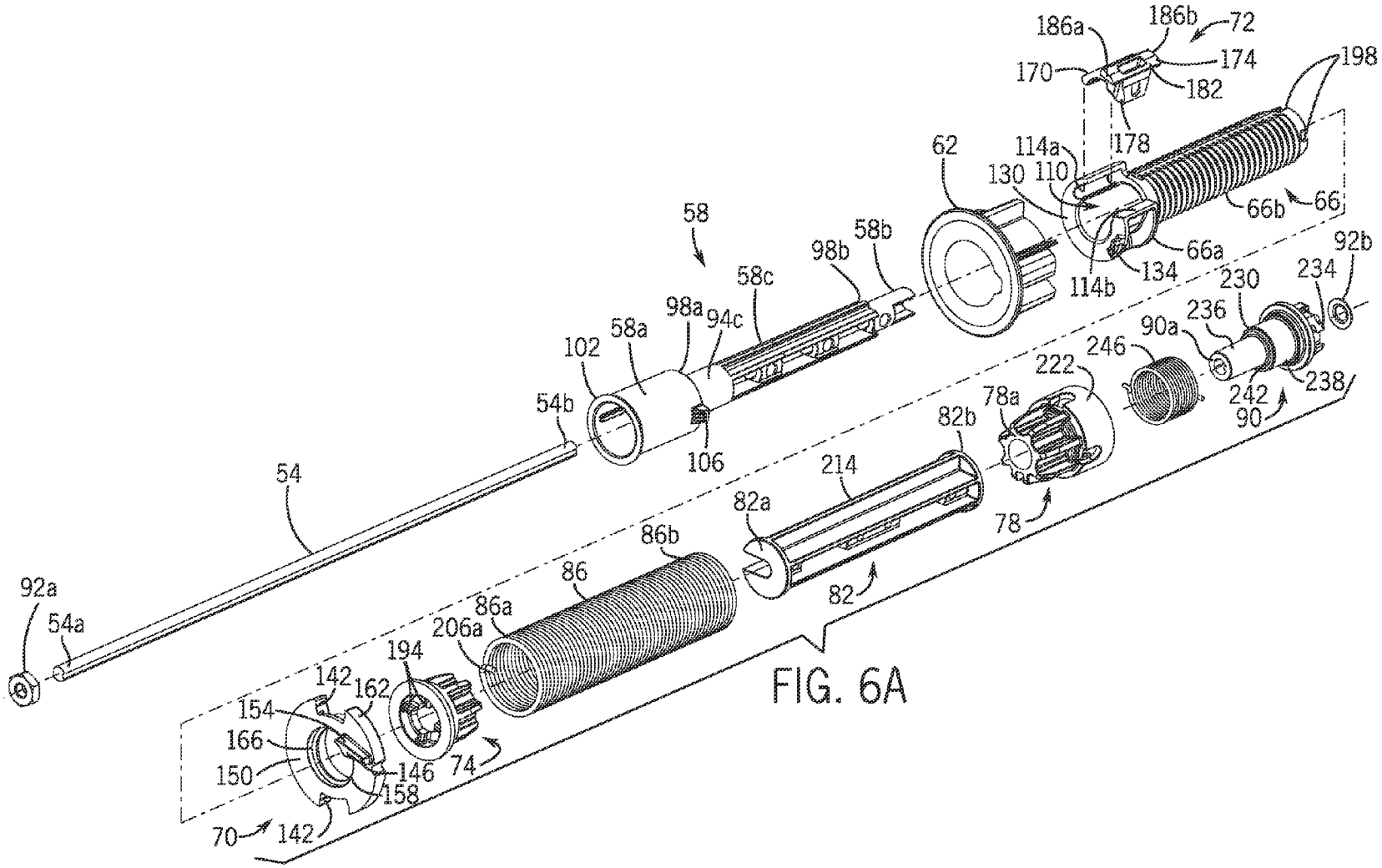
FIGS. 6A and 6B are exploded, isometric views of the supplemental revolution assembly of FIG. 4.
Figure 6B:
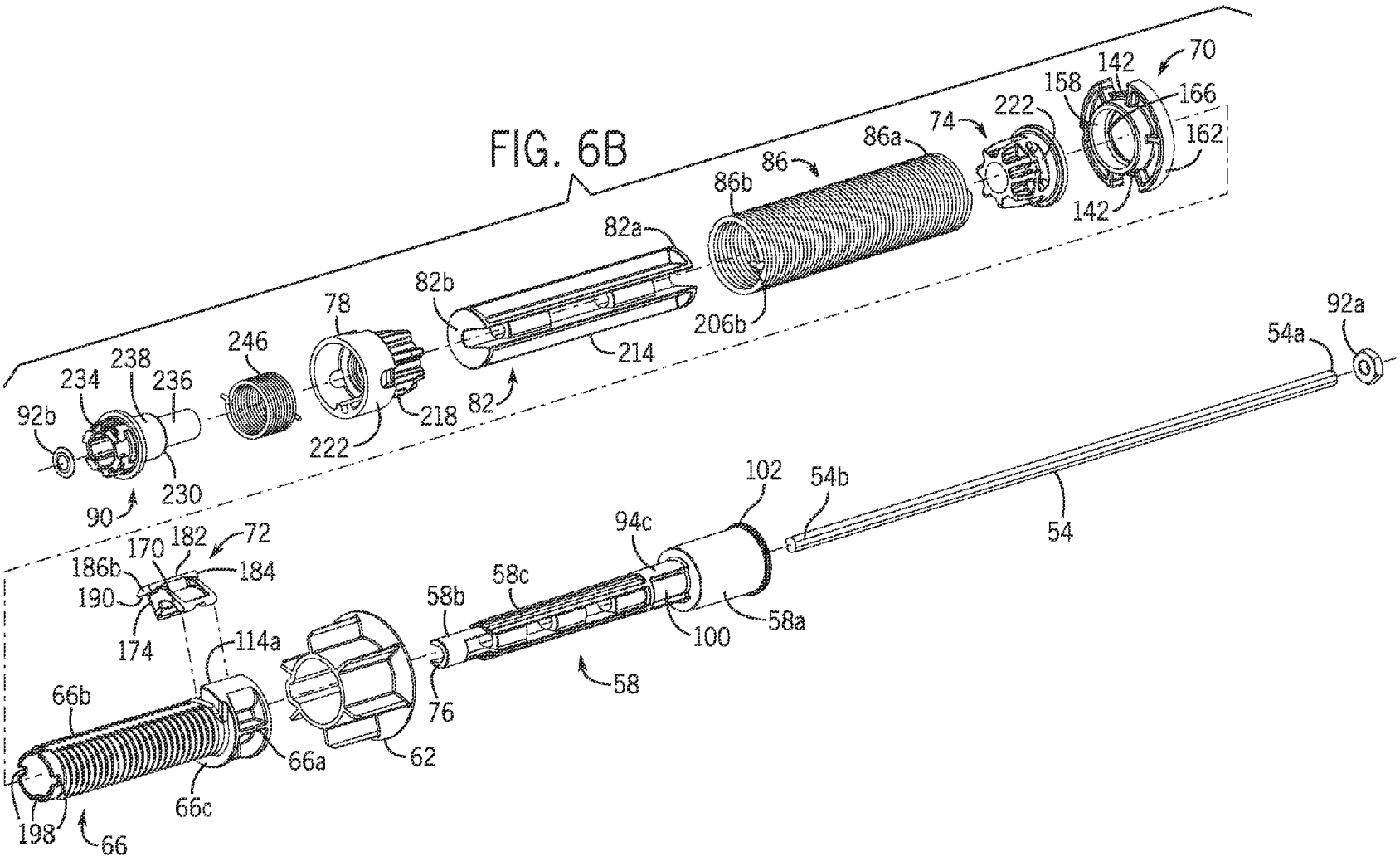

The non-rotatable anchor 58 may include a cascading outer surface. For example, the proximal section 58*a*, the intermediate section 58*c*, and the distal section 58*b* each may include an outer surface with decreasing outer diameters. That is, the proximal section 58*a* may include an outer surface 94*a* having a first diameter, the intermediate section 58*c* may include an outer surface 94*c* having a second diameter, and the distal section 58*b* may include an outer surface 94*b* having a third diameter, with the first diameter being larger than the second diameter, and the second diameter being larger than the third diameter. Shoulders 98*a*, 98*b* may be formed at the transition between the proximal section 58*a* and the intermediate section 58*c* and between the intermediate section 58*c* and the distal section 58*b*, respectively. As depicted in FIG. 6A, a circumferential pocket or recess 100 may be formed in the outer surface 94*c* of the intermediate section 58*c* proximate to the transitionary shoulder 98*a*.

With continued reference to FIGS. 4, 5, 6A, and 6B, the bearing 62 may be configured to support an end of the roller 42. The bearing 62 may be rotatably mounted onto the non-rotatable anchor 58 and may rotatably bear against the outer surface 94*a* of the proximal section 58*a* of the anchor 58. The bearing 62 may be axially retained on the proximal section 58*a* between a radially-outward lip 102 and a stop 106. The bearing 62 may include a plurality of circumferentially-spaced, radially-extending ribs configured to engage an inner surface of the roller 42 and/or interact with the longitudinally-extending glands 46. As such, the bearing 62 may be rotatably keyed to the roller 42 to rotate in unison with the roller 42.

Still referring to FIGS. 4, 5, 6A, and 6B, the shaft 66 may be rotatably mounted onto the non-rotatable anchor 58 and may rotatably bear against the outer surface 94*c* of the intermediate section 58*c* of the anchor 58. The rotatable shaft 66 may include a proximal section 66*a* and a distal section 66*b* separated from each other by a shoulder 66*c*. The proximal section 66*a* of the rotatable shaft 66 may abut or bear against the transitionary shoulder 98*a* of the non-rotatable anchor 58 and may be positioned around the intermediate section 58*c* of the anchor 58 containing the pocket 100. The distal section 66*b* of the rotatable shaft 66 may extend around the intermediate section 58*c* of the elongate anchor 58 to a position proximate the transitionary shoulder 98*b*. The distal section 66*b* of the rotatable shaft 66 may be externally-threaded.

With reference to FIGS. 5, 6A, 6B, and 7, the rotatable shaft 66 may define an aperture or cavity 110. When the supplemental revolution assembly 50 is assembled and positioned at least partially within the roller 42, the cavity 110 may open radially-inward to non-rotatable anchor 58 and may open radially-outward to the roller 42. In one implementation, the cavity 110 may be longitudinally aligned with the pocket 100 of the anchor 58 so that the cavity 110 selectively opens to the pocket 100 based upon the rotational position of the rotatable shaft 66 relative to the non-rotatable anchor 58.

The cavity 110 may be defined by opposing, circumferentially-spaced side walls 114*a*, 114*b* extending from an inner wall 118*a* of the shaft 66 to an outer wall 118*b* of the shaft 66. One side wall 114*a* may define a hook-shaped or J-shaped seat or socket 122 having a shorter wall segment 122*a*, a longer wall segment 122*b* spaced radially-outward from the shorter wall segment 122*a*, and an intermediate wall segment 122*c* connecting the shorter and longer wall segments 122*a*, 122*b*. The longer wall segment 122*b* may be formed at an angle $\alpha$ from a vertical plane extending through a longitudinal centerline of the rotatable shaft 66. The intermediate wall segment 122*c* may have a center of curvature C1 and a radius R1.

The other side wall 114*b* of the rotatable shaft 66 may include an arcuate or curved wall segment 126 extending outward from the inner wall 118*a*. The curved wall segment 126 may have a radius R2 originating at the center of curvature C1 associated with the seat 122. In one implementation, the angle $\alpha$ is approximately 20 degrees, the radius R1 is approximately 0.134 inches, the radius R2 is approximately 0.550 inches, a diameter D1 of the inner wall 118*a* is approximately 0.528 inches, and a diameter D2 of the outer wall 118*b* is approximately 1.040 inches. The cavity 110 may open through a proximal face 130 of the rotatable shaft 66.

Figure 7:
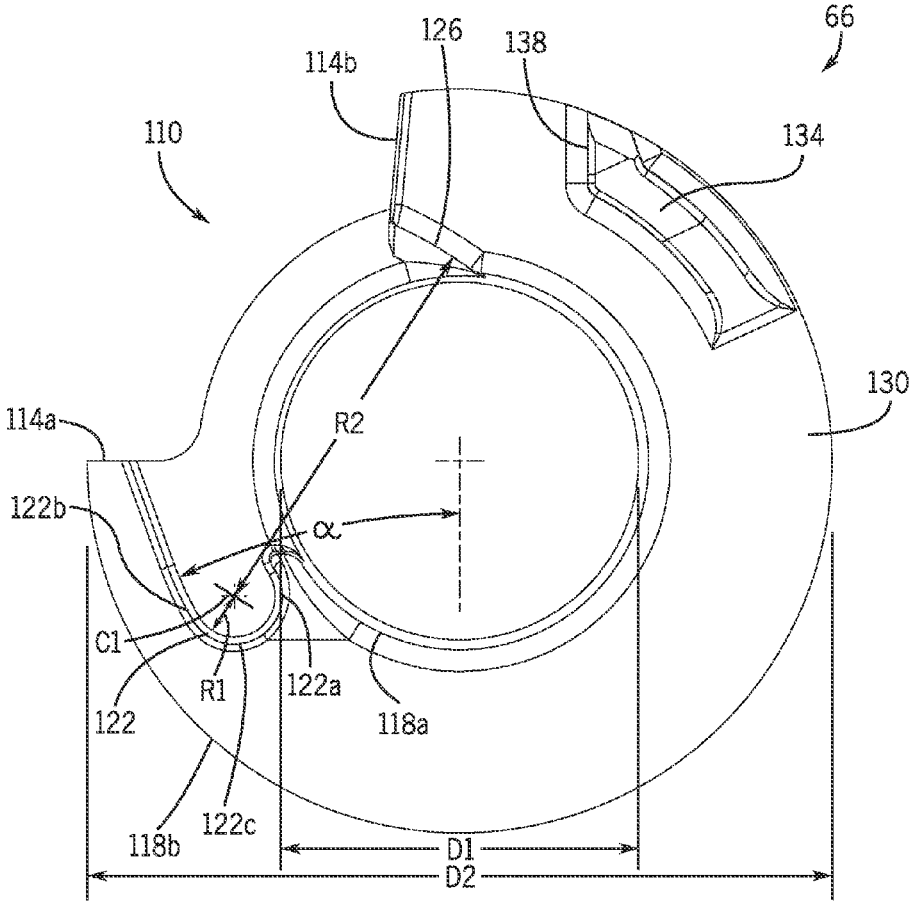
FIG. 7 is a proximal elevation view of a rotatable shaft of the supplemental revolution assembly of FIG. 4.
Figure 8:
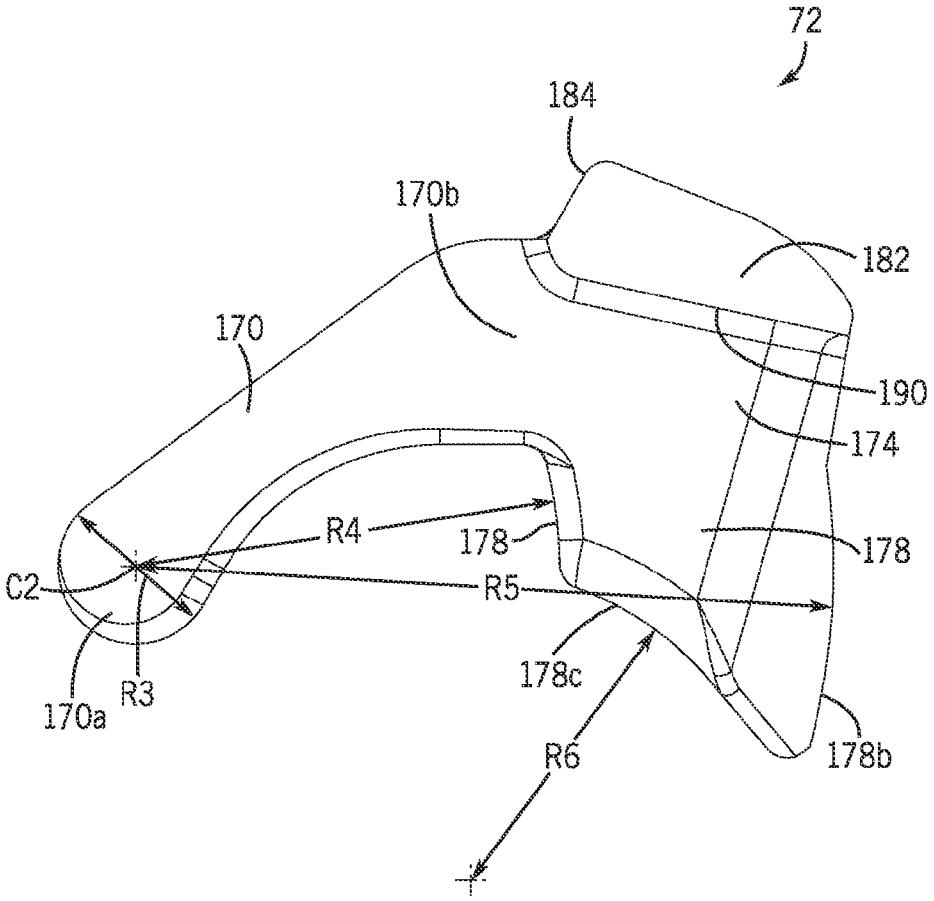
FIG. 8 is proximal elevation view of a pawl of the supplemental revolution assembly of FIG. 4.

Still referring to FIGS. 5, 6A, 6B, and 7, the rotatable shaft 66 may include a tab 134 configured to selectively limit rotation of the rotatable shaft 66 about the non-rotatable anchor 58. The tab 134 may protrude from a proximal face 130 of the rotatable shaft 66 and may be configured to interact with the stop 106 formed on the anchor 58. In other words, the stop 106 may be located within a rotational path of the tab 134 to limit rotation of the shaft 66. The tab 134 may include a contact face 138 configured to engage the stop 106 to prevent further rotation of the shaft 66 in a certain direction, which may be counterclockwise as shown in FIG. 7. In one implementation, the rotation of the rotatable shaft 66 is limited to approximately 180 degrees by the tab 134 and the stop 106.

With reference to FIGS. 4, 5, 6A, and 6B, the translatable nut 70 may be threadably mounted onto the threaded section 66*b* of the shaft 66 and may be rotatably keyed to the roller 42 to rotate in unison with the roller 42. The nut 70 may define a pair of circumferentially-spaced slots 142 opening through a periphery of the nut 70 and configured to receive the longitudinally-extending glands 46 of the roller 42. The nut 70 may axially advance along the threaded section 66*b* of the tubular shaft 66 toward the proximal section 66*a* of the tubular shaft 66 during rotation of the roller 42 in a shade dispensing or extending direction. Conversely, the nut 70 may travel away from the proximal section 66*a* during rotation of the roller 42 in a shade raising or retracting direction.

With reference to FIGS. 5 and 6A, the nut 70 may include a cam or lug 146 projecting from a proximal face 150 of the nut 70. The cam 146 may include a cam surface 154 extending outward from near an inner bore wall 158 of the nut 70 toward an outer periphery wall 162 of the nut 70. The cam surface 154 may be inclined in a clockwise direction when viewing the proximal face 150 of the nut 70 (such as in FIG. 6A). The cam surface 154 may be arcuate, curved, linear, straight, or any combination thereof. The nut 70 also may include a thread 166 extending radially inward from the inner bore wall 158 and configured to threadably engage the threaded section 66*b* of the tubular shaft 66.

With reference to FIGS. 4-8, the pawl 72 may be pivotably seated in the cavity 110 of the rotatable shaft 66. The pivotable pawl 72 may include a neck portion 170 and a head portion 174. The neck portion 170 may include two ends 170*a*, 170*b*, one of which may be configured to pivot within the seat 122 and the other of which may integrally transition into the head portion 174. The seat end 170*a* of the neck portion 170 may have an arcuate or curved outer surface corresponding to the shape of the seat 122 and may have a center of curvature C2 and a radius R3. The center of curvature C2 may serve as the pivot axis of the pivotable pawl 72 and may be substantially parallel to a longitudinal axis or centerline of the roller 42 and/or the supplemental revolution assembly 50. As such, the head portion 174 may be movable between a radially-inward position and a radially-outward position. In one implementation, the pawl 72 has a pivotable range of approximately thirty degrees.

With continued reference to FIGS. 4-8, the head portion 174 of the pivotable pawl 72 may include an anchor region 178 located radially inward of a roller region 182. The anchor region 178 may be configured to engage the non-rotatable anchor 58 to restrain rotation of the rotatable shaft 66. The anchor region 178 may include a proximal face 178*a*, a distal face 178*b*, and an intermediate face 178*c* extending between the proximal and distal faces 178*a*, 178*b*, with the proximal and distal terminology defined relative to the center of curvature C2. The proximal and distal faces 178*a*, 178*b* may be arcuate or curved and have radii R4, R5, respectively, originating at the center of curvature C2. The intermediate face 178*c* may be arcuate or curved and have a radius of R6. In one implementation, the radius R3 is approximately 0.125 inches, the radius R4 is approximately 0.340 inches, and the radius R5 is approximately 0.560 inches.

Still referring to FIGS. 4-8, the roller region 182 may be configured to engage a longitudinally-extending gland 46 of the roller 42. The roller region 182 may include a longitudinally-extending abutment surface 184 positioned on a similar side of the head portion 174 as the proximal face 178*a* of the anchor region 178 and opposite of the distal face 178*b* of the anchor region 178. The abutment surface 184 and/or a portion of the gland 46 may include a dampening or shock-absorbent material to reduce and/or eliminate any audible effect of the pivotable pawl 72 contacting the roller 42.

The roller region 182 also may include a distally-extending ear or wing 186*a* (relative to the proximal face 130 of the rotatable shaft 66). The distally-extending ear 186*a* may include a following surface 190 configured to ride along the cam surface 154 of the nut 70. In operation, as the shade 22 approaches a predetermined extended position, the travelable nut 70 advances along the threaded section of the shaft 66 toward the pivotable pawl 72. The supplemental revolution assembly 50 is mechanically toleranced and timed so that as the shade 22 reaches the predetermined shade position, the cam 146 contacts the ear 186*a* and pivots the pawl 72 from the radially-inward position into the radially-outward position, thereby disengaging the pivotable pawl 72 from the pocket 100 of the non-rotatable anchor 58. The roller region 182 further may include a proximally-extending ear or wing 186*b* (relative to the proximal face 130 of the tubular shaft 66). The proximally-extending ear 186*b* may be radially located on the head portion 174 of the pawl 72 to clear or pass by the stop 106 without interference when the pawl 72 is in the radially-outward position.

With reference to FIGS. 4-6B, the rotatable spring fitting 74 may be configured to couple the distal section 66*b* of the rotatable shaft 66 to a proximal end 86*a* of the torsion spring 86, which may bias the rotatable shaft 66 in a shade extension direction. The rotatable spring fitting 74 may be keyed to the distal section 66*b* of the shaft 66 so that the rotatable spring fitting 74 rotates in unison with the rotatable shaft 66. In one implementation, the rotatable spring fitting 74 includes a plurality of knobs 194 configured to engage corresponding cutouts 198 formed in the distal section 66*b* of the rotatable shaft 66, although any other suitable keying structures may be used. The rotatable spring fitting 74 also may be keyed to the torsion spring 86 so that proximal end 86*a* of the torsion spring rotates in unison with the rotatable spring fitting 74. In one implementation, the rotatable spring fitting 74 includes a channel 202 configured to receive a tang 206*a* formed on a proximal end 86*a* of the torsion spring 86, although any other suitable keying structures may be used. As such, the rotatable shaft 66 may rotate in unison with the proximal end 86*a* of the torsion spring 86.

With continued reference to FIGS. 4-6B, the spacer 82 may be insertable into an interior space of the torsion spring 86 to longitudinally separate the spring fittings 74, 78. When the supplemental revolution assembly 50 is assembled, a proximal face 82*a* of the spacer 82 may abut a distal face 76 of the non-rotatable anchor 58, and a distal face 82*b* of the spacer 82 may abut a proximal face 90*a* of the distal coupling 90. The spacer 82 may include a longitudinal bore 210 extending centrally through the spacer 82 and configured to snugly receive the central axle 54. The spacer 82 may include a plurality of circumferentially-spaced, longitudinally-extending fins 214. The spacer 82 may have a diameter configured to substantially prevent buckling or lateral deflection of the torsion spring 86.

With further reference to FIGS. 4-6B, the non-rotatable spring fitting 78 may be configured to couple a distal end 86*b* of the torsion spring 86 to the distal coupler 90. The non-rotatable spring fitting 78 may be keyed to the torsion spring 86 so that the distal end 86*b* of the torsion spring 86 rotates in unison with the non-rotatable spring fitting 78. That is, during operation of the shade 22, the distal end 86*b* of the torsion spring 86 is rotatably fixed. In one implementation, the non-rotatable spring fitting 78 includes a channel 218 configured to receive a tang 206*b* formed on a distal end 86*b* of the torsion spring 86, although any other suitable keying structures may be used. The non-rotatable spring fitting 78 also may include a distally-extending sleeve 222.

Still referring to FIGS. 4-6B, the distal coupler 90 may be rotatably keyed to the central axle 54 and thus rotatably fixed. The distal coupler 90 may include a proximally-extending mandrel 230 and a distally-extending fitting 234, which may include a keying structure for connection to other assemblies that may be positioned within the roller 42. The mandrel 230 may include a multi-staged outer surface having a smaller diameter proximal section 236 and a larger diameter distal section 238. A shoulder 242 may be located between the proximal and distal sections 236, 238.

The proximal section 236 of the mandrel 230 may snugly fit into a central bore of the non-rotatable spring fitting 78 and abut the distal face 82*b* of the spring spacer 82. The shoulder 242 may axially retain the non-rotatable spring fitting 78 between the spacer 82 and the distal coupler 90. The distal section 238 of the mandrel 230 may be positioned within the sleeve 222 of the non-rotatable spring fitting 78. The distal section 238 may an outer diameter that is smaller than an inner diameter of the sleeve 222, thereby defining an annular space between the sleeve 222 and the mandrel 230.

With continued reference to FIGS. 4-6B, a wrap spring 246 may be interference fit onto the distal section 238 of the mandrel 230. The wrap spring 246 may be keyed to the sleeve 222 of the non-rotatable spring fitting 78 so that the wrap spring 246 and the sleeve 222 rotate in unison about the distal coupler 90. The wrap spring 246 may be configured to slip around the distal section 238 of the coupler 90 in one rotational direction to permit an assembler, installer, and/or operator to impart a torque preload on the torsion spring 86 by rotating the non-rotatable spring fitting 78 relative to the rotatable spring fitting 74 (which may be rotatably fixed by the pivotable pawl 72) and to the distal coupler 90. In other words, the non-rotatable spring fitting 78 may rotate the distal end 86*b* of the torsion spring 86 relative to the proximal end 86*a* of the torsion spring, thereby imparting a preload on the torsion spring 86. The preloaded torsion spring 86 may bias the rotatable shaft 66 in a shade extension direction.

To maintain the preload in the torsion spring 86, the wrap spring 246 may be configured to bind or lock around the distal section 238 of the mandrel 230 in an opposite rotational direction. After setting the preload, the non-rotatable spring fitting 78 and the distal coupler 90 may be rotatably fixed together to prevent inadvertent alteration of the torque preload. For instance, the non-rotatable spring fitting 78 and the distal coupler 90 may include complementary keying structures that engage each other upon a predefined insertion of the distal coupler 90 into the non-rotatable spring fitting 78. Other suitable devices for setting a preload in the torsion spring 86 may be used.

Figure 9A:
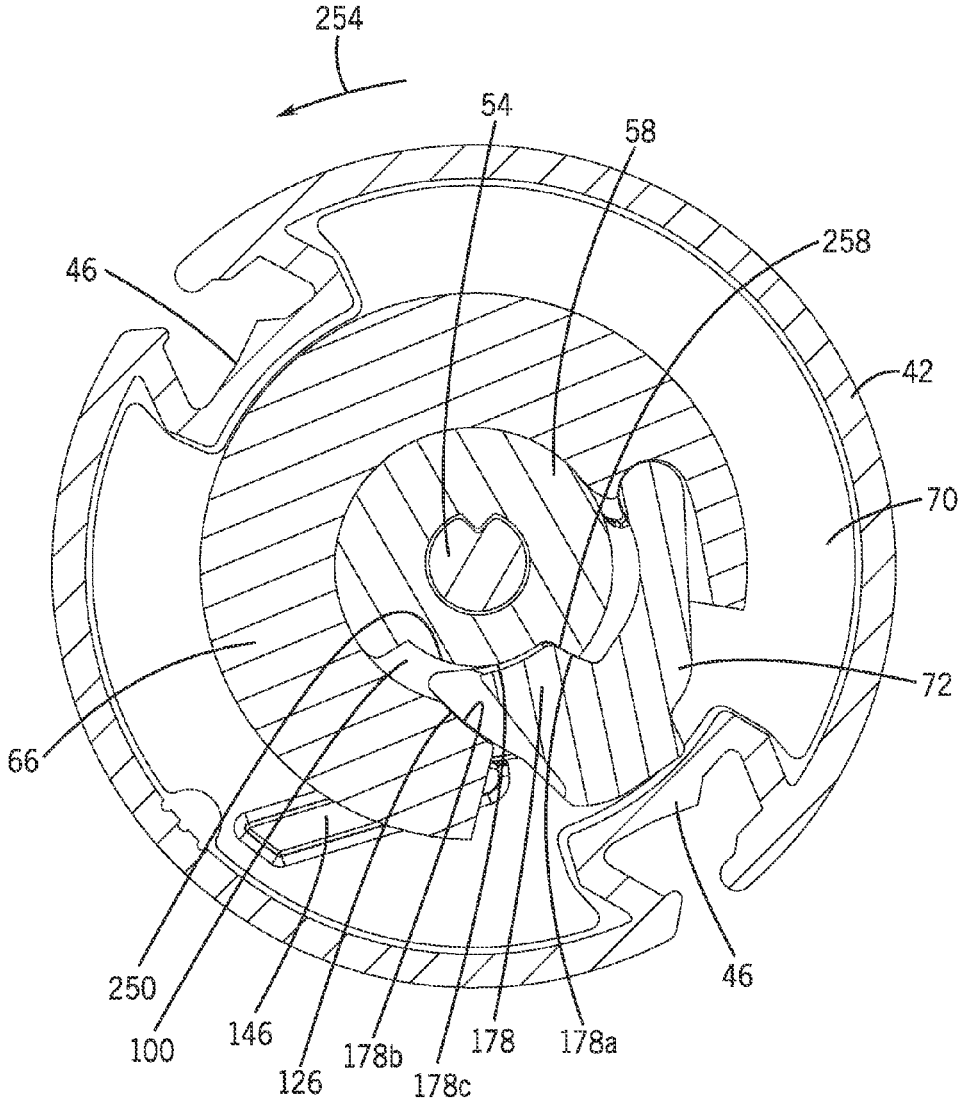
FIGS. 9A, 9B, 9C, 9D, and 9E are section views of the supplemental revolution assembly of FIG. 4 in various operational positions within a roller. These section views illustrate the interaction of a pivotable pawl, a non-rotatable anchor, a rotatable shaft, a translatable nut, and a rotatable roller.

With reference to FIGS. 1-3D and 9A-9E, the supplemental revolution assembly 50 is shown in various operational positions. Referring to FIG. 9A, the pivotable pawl 72 is secured in a radially-inward position in which the longitudinally-extending glands 46 of the roller 42 rotate around the pivotable pawl 72 without interference during shade extension and/or retraction. To maintain the pivotable pawl 72 in the radially-inward position, the pawl 72 may be compressed between the non-rotatable anchor 58 and the rotatable shaft 66. In one implementation, the head portion 174 of the pawl 72 may extend into the pocket 100 of the non-rotatable anchor 58 and the intermediate face 178*c* may abut or contact an arcuate or curved base wall 250 of the pocket 100.

As previously discussed, the rotatable shaft 66 may be biased in a shade extension direction 254 (depicted as counterclockwise in FIG. 9A) by the preloaded torsion spring 86. Thus, the curved wall segment 126 of the rotatable shaft 66 may be biased into contact with the distal face 178*b* of the pivotable pawl 72. The orientation of the engagement area between the curved wall segment 126 and the distal face 178*b* may create a normal force with a radially-inward component and a radially-tangential component, thereby forcing the intermediate face 178*c* of the pawl 72 into contact with the base 250 of the pocket 100 of the anchor 58 and forcing the proximal face 178*a* of the pawl 72 into contact with a side wall 258 of the pocket 100 of the anchor 58. As such, the pivotable pawl 72 may be rotationally constrained to the non-rotatable anchor 58, thereby rotationally constraining the rotatable shaft 66. In other words, the supplemental revolution assembly 50 may be rotationally constrained in a static, preloaded state during a majority of the shade 22 movement. In this state, the supplemental revolution assembly 50 may not interfere with the operation of the shade 22.

Figure 9B:
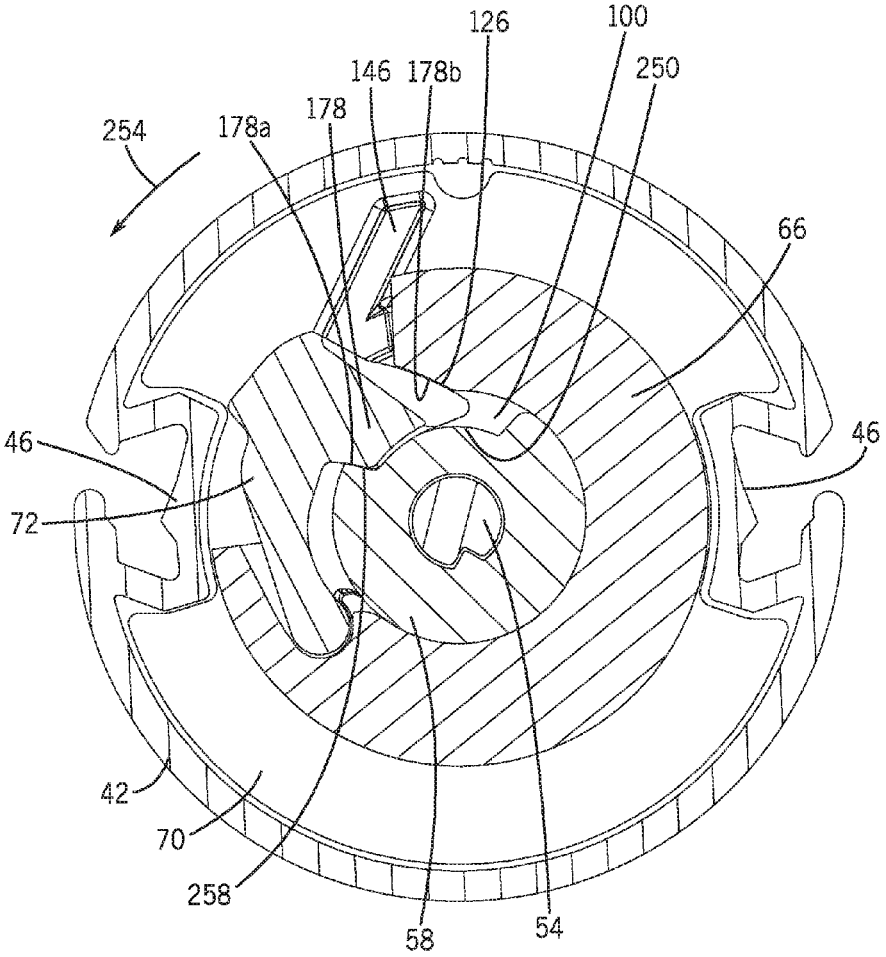
Figure 9C:
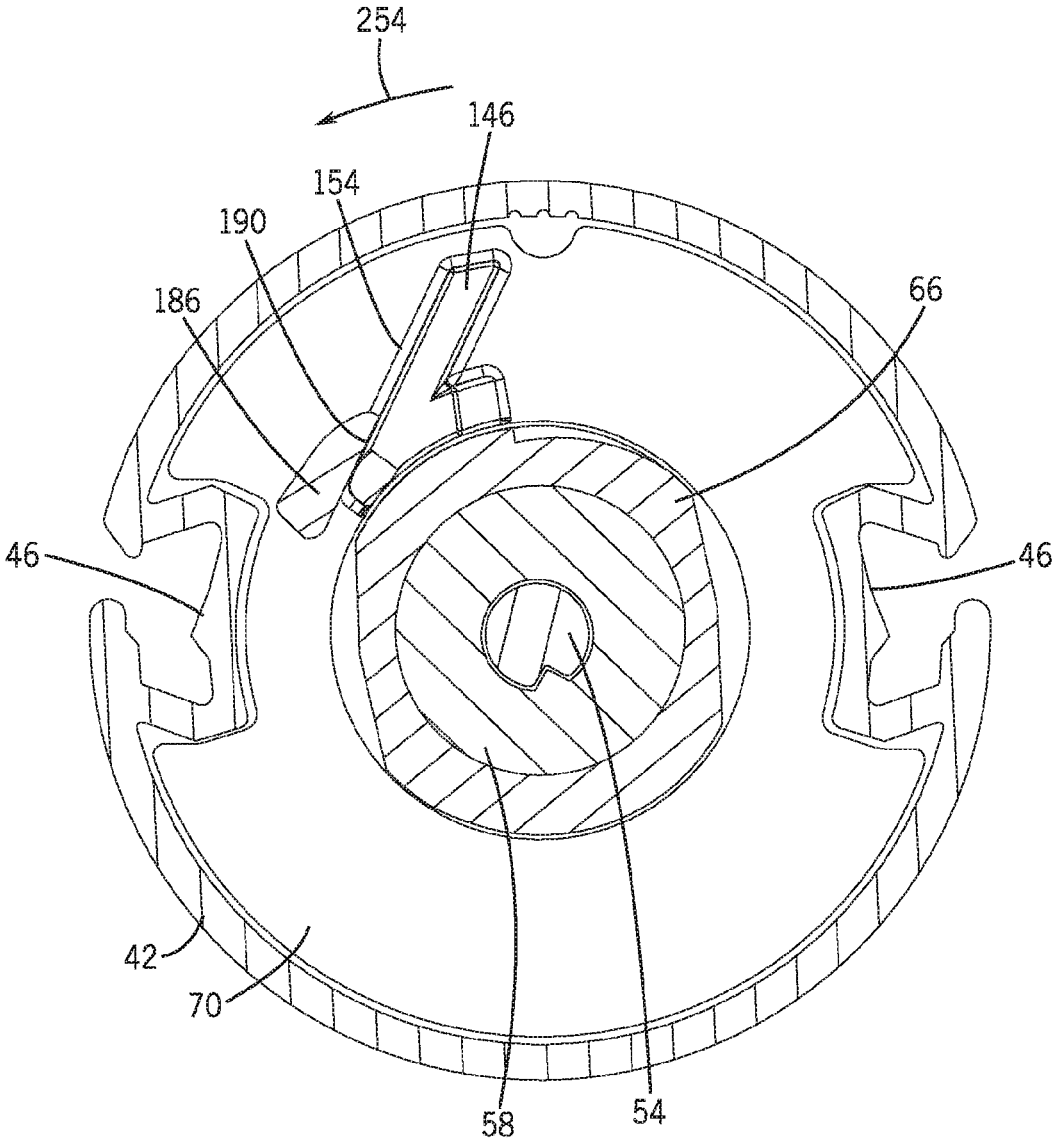

Once the shade 22 is extended to a specific extended position, the pivotable pawl 72 may be disengaged or lifted from the non-rotatable anchor 58 to permit rotation of the shaft 66 under the influence of the torsion spring 86. With reference to FIGS. 3A, 9B, and 9C, during rotation of the roller 42 in a shade extension direction 254, the travelable nut 70 rotates in unison with the roller 42 and advances along the shaft 66 toward the pivotable pawl 72. As the shade 22 approaches the specific extended position (for example the shade position depicted FIG. 1), the cam 146 of the nut 70 may approach the ear 186 of the pawl 72 (see FIG. 9C). As the roller 42, and thus the nut 70, continue to rotate in the extension direction 254 under the influence of gravity, the cam 146 may rotate beneath the ear 186 and the cam surface 154 may contact the following surface 190, which in turn may ride along the cam surface 154 to pivot the pawl 72 out of the pocket 100 of the non-rotatable anchor 58. During the pivotal movement of the pawl 72 from the pocket 100, the pawl 72 may be radially positioned to engage a longitudinally-extending gland 46 of the roller 42 (see FIG. 9D). The cam 146 may be configured to disengage the pawl 72 from the non-rotatable anchor 58 over a relatively small angular rotation (for example a couple of degrees).

Figure 9D:
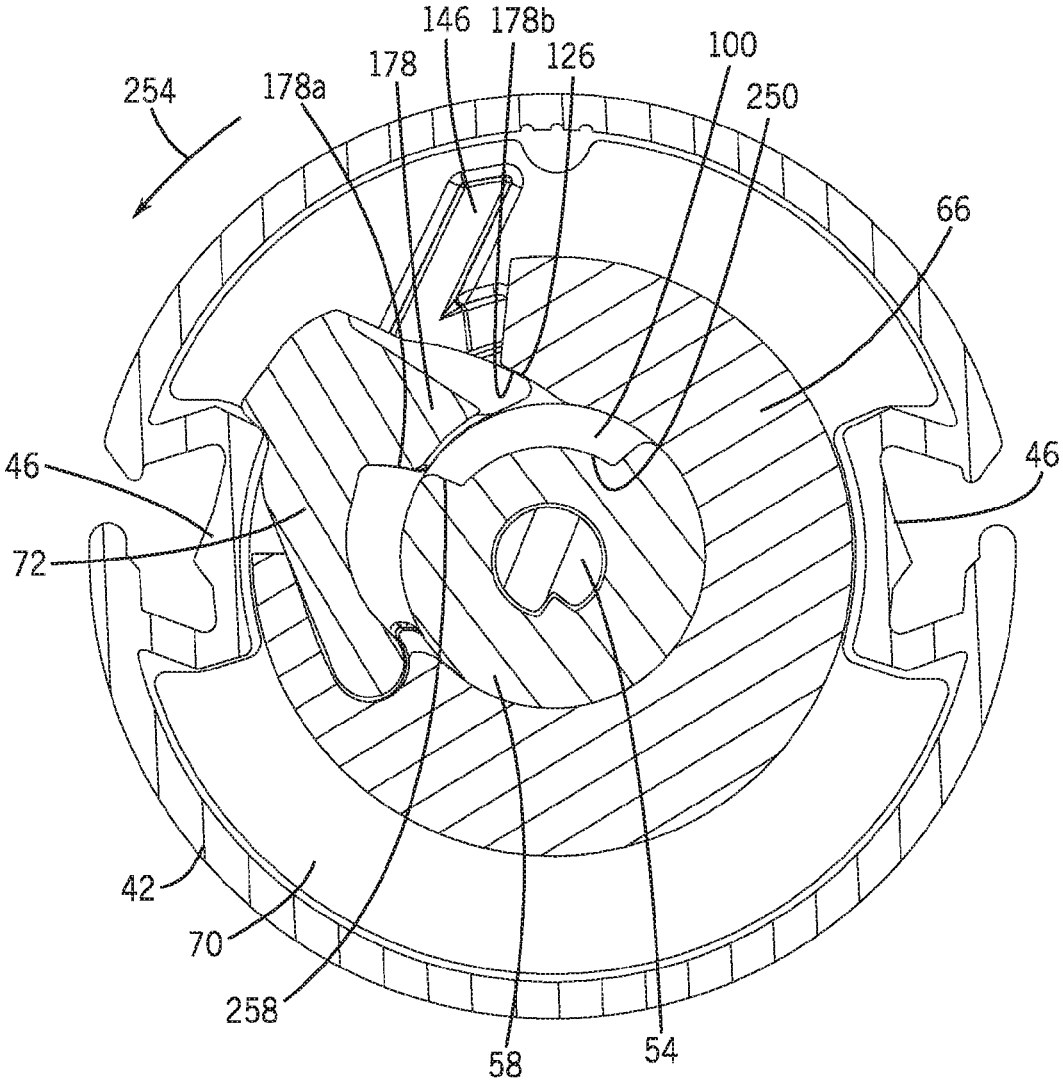

With reference to FIG. 9D, after the pawl 72 is disengaged from the non-rotatable anchor 58, the pawl 72 contacts or engages one of the glands 46 of the roller 42. The initial contact or engagement between the pawl 72 and the gland 46 may occur as the roller 42 begins a final one-half revolution in an extending direction, as shown in FIGS. 1, 3A, and 9D. Once in contact or engagement, the pawl 72 may rotate the roller 42 in the extension direction 48 (see FIGS. 3A-3D) to fully extend the shade 22 (see FIG. 2).

With reference to FIGS. 3A-3D, 9D, and 9E, once the pivotable pawl 72 is disengaged from the non-rotatable anchor 58 by the travelable nut 70, the torsion spring 86 rotates the shaft 66, which in turn rotates the pawl 72 about a longitudinal axis of the roller 42 in the shade extension direction 254. During this rotation, the pawl 72 may contact and rotate the roller 42 in the shade extension direction 254. In one implementation, the abutment surface 184 of the roller region 182 of the pawl 72 contacts the gland 46 to rotate the roller. When the pawl 72 is disengaged from the anchor 58, the intermediate face 178*c* of the head portion 174 of the pawl 72 may rotatably bear against the outer surface 94*c* of the anchor 58 and the neck portion 170 of the pawl 72 may contact the longer wall segment 122*b* of the shaft 66 to maintain the pivotable position of the pawl 72, thereby ensuring the pivotable pawl 72 remains in contact or engagement with the gland 46. Upon a supplemental amount of rotation of the shaft 66 relative to the anchor 58, the tab 134 of the rotatable shaft 66 may contact or engage the stop 106 of the non-rotatable anchor 58, thereby limiting the amount of supplemental rotation of the roller 42. In one implementation, the amount of supplemental rotation of the roller 42 is about one-half revolution of the roller 42.

Generally, the supplemental revolution assembly 50 may be configured to supplementally rotate the roller 42 any desired rotational amount after the shade reaches a desired extended, closed position, such as a final revolution of the roller 42 associated with a fully extended shade position. As shown in FIGS. 1, 3A, and 9B-9D, the pivotable pawl 72 may initially contact or engage the roller 42 as the shade reaches a fully extended, closed position, which may correspond to a final one-half revolution of the roller 42. At this fully extended, closed position, the vanes 38 may remain generally closed. Referring specifically to FIGS. 3A-3D and 9D-9E, after contact or engagement, the pivotable pawl 72 may drive or rotate the roller 42 in the shade extension direction 48 toward an open position in which the front and rear sheets 30, 34 are laterally spaced from one another and the vanes 38 are substantially horizontal (see FIG. 2). In this fully open position, the tab 134 of the rotatable shaft 66 may contact or engage the stop 106 of the non-rotatable anchor 58 (see FIG. 6A) to inhibit the pivotable pawl 72 from further rotating the roller 42 under the bias of the torsion spring 66. As such, in one implementation, the supplemental revolution assembly 50 may supplementally rotate a roller 42 once the shade has reached a fully extended, closed position (such as during a final one-half revolution of the roller 42) to reconfigure the shade 22 from an extended and closed-vane position (see FIG. 1, for example) to an extended and open-vane position (see FIG. 2, for example). The amount of supplemental rotation may be adjusted or selected to open the vanes a varying amount by altering the relative positioning of the stop 106 and the tab 134.

Figure 9E:
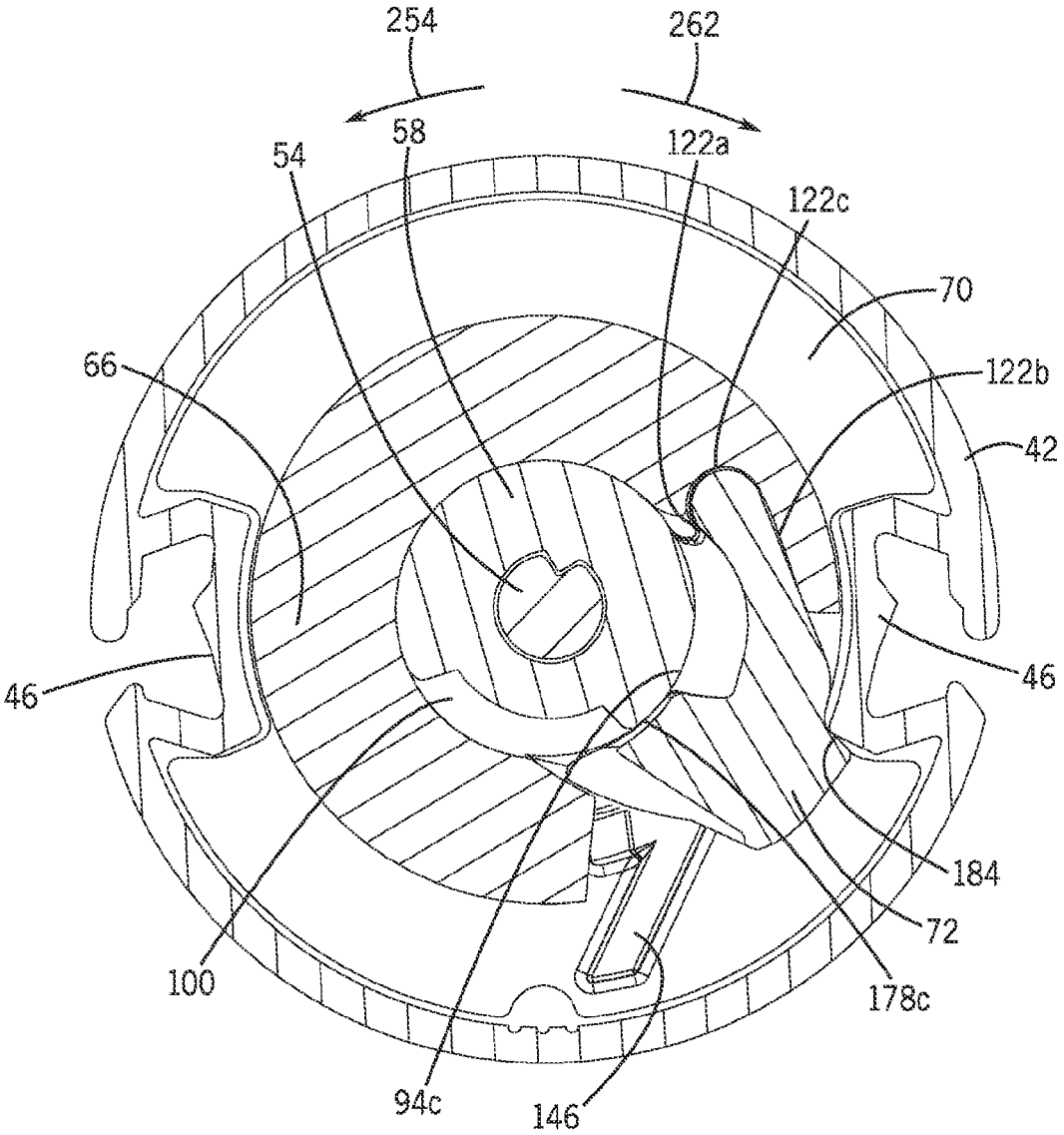

After rotating the roller 42 the supplemental amount, the pivotable pawl 72 may be reset into the locked or radially-inward position during normal operation of the covering 10. With reference to FIG. 9E (which generally corresponds to FIGS. 2 and 3D), during rotation of the roller 42 in a retraction direction 262, the gland 46 may contact the pivotable pawl 72 and rotate the shaft 66 in the retraction direction 262 against the bias of the torsion spring 86, thereby preloading the torsion spring 86. The orientation of the engagement area between the gland 46 and the abutment surface 184 of the pawl 72 may create a normal force having a radially-inward component and a radially-tangential component. Thus, once the anchor region 178 of the pivotable pawl 72 is rotatably aligned with the pocket 100, the gland 46 may pivot the pawl 72 into the pocket 100. As previously discussed, once the pivotable pawl 72 is seated in the pocket 100, the head portion 178 of the pivotable pawl 72 may be compressed between a side wall 258 of the pocket 100 and a curved wall segment 126 of the shaft 66, thereby constraining the pivotable pawl 72 to the non-rotatable anchor 58. In this position, the constrained pawl 72 limits rotation of the shaft 66, thereby maintaining the preload in the torsion spring 86 for the next lowering cycle. Upon the pivotable pawl 72 moving into a radially-inward position in the pocket 100, the gland 46 may pass freely by the pawl 72 without interference. In other words, once in the radially-inward position, the pivotable pawl 72 may not interfere with rotation of the roller 42 and thus further retraction of the shade 22 may occur nominally.

The foregoing has many advantages. For instance, as described, the supplemental revolution assembly may be automatically actuated or triggered during normal extension of a shade to complete or finish a shade extension operation, which may work against gravitational forces, without requiring additional steps by an operator. Further, the supplemental revolution assembly may be automatically reset during normal retraction of the shade from an extended position. Moreover, the supplemental revolution assembly may be scalable to accommodate different shade sizes. For instance, the size of the torsion spring 86 (e.g., the length and/or wire diameter) may be varied depending upon the weight of the shade 22. To accommodate the different torsion spring 86 sizes, the length of the axle 54 and of the spacer 82 may be varied accordingly. Also, the diameter of the spacer 82 may be varied to accommodate the size of the torsion spring 86.

The components of the supplemental revolution assembly 50 may be manufactured from various materials. In one implementation, the non-rotatable anchor 58, the travelable nut 70, the fittings 74, 78, and the distal coupler 90 are formed from nylon reinforced with glass fibers, the rotatable shaft 66 is formed from polycarbonate, the pivotable pawl 72 and the spacer 82 are formed from acetal, and the torsion spring 86 is formed from music wire. Other suitable materials may be used.

The foregoing description has broad application. While the provided examples describe a silhouette-type shade, it should be appreciated that the concepts disclosed herein may equally apply to any type of shade that may selectively use supplemental energy to actuate, extend, and/or open a shade. For instance, the supplemental revolution assembly may be used to actuate operable vanes attached a support sheet. Further, while the provided examples describe the supplemental revolution assembly as assisting in an extension of a shade, the supplemental revolution assembly may be configured to assist in raising or retracting a shade. Accordingly, the discussion of any embodiment is meant only to be explanatory and is not intended to suggest that the scope of the disclosure, including the claims, is limited to these examples. In other words, while illustrative embodiments of the disclosure have been described in detail herein, it is to be understood that the inventive concepts may be otherwise variously embodied and employed, and that the appended claims are intended to be construed to include such variations, except as limited by the prior art.

The foregoing discussion has been presented for purposes of illustration and description and is not intended to limit the disclosure to the form or forms disclosed herein. For example, various features of the disclosure are grouped together in one or more aspects, embodiments, or configurations for the purpose of streamlining the disclosure. However, it should be understood that various features of the certain aspects, embodiments, or configurations of the disclosure may be combined in alternate aspects, embodiments, or configurations. Moreover, the following claims are hereby incorporated into this Detailed Description by this reference, with each claim standing on its own as a separate embodiment of the present disclosure.

The phrases "at least one", "one or more", and "and/or", as used herein, are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

The term "a" or "an" entity, as used herein, refers to one or more of that entity. As such, the terms "a" (or "an"), "one or more" and "at least one" can be used interchangeably herein.

The use of "including," "comprising," or "having" and variations thereof herein is meant to encompass the items listed thereafter and equivalents thereof as well as additional items. Accordingly, the terms "including," "comprising," or "having" and variations thereof are open-ended expressions and can be used interchangeably herein.

All directional references (e.g., proximal, distal, upper, lower, upward, downward, left, right, lateral, longitudinal, front, back, top, bottom, above, below, vertical, horizontal, radial, axial, clockwise, and counterclockwise) are only used for identification purposes to aid the reader's understanding of the present disclosure, and do not create limitations, particularly as to the position, orientation, or use of this disclosure. Connection references (e.g., attached, coupled, connected, and joined) are to be construed broadly and may include intermediate members between a collection of elements and relative movement between elements unless otherwise indicated. As such, connection references do not necessarily infer that two elements are directly connected and in fixed relation to each other. Identification references (e.g., primary, secondary, first, second, third, fourth, etc.) are not intended to connote importance or priority, but are used to distinguish one feature from another. The drawings are for purposes of illustration only and the dimensions, positions, order and relative sizes reflected in the drawings attached hereto may vary.

What is claimed is:

1. A covering for an architectural opening, the covering comprising:
a rotatable roller;
a shade suspended from the roller and wrappable about the roller; and
an assembly associated with the roller, the assembly comprising:
a biasing element operably associated with the roller to selectively rotate the roller in an extension direction, the biasing element having a preload; and
a retention element associated with the biasing element and operable to release the preload at an extended shade position, the retention element being triggered to release the preload upon the shade reaching the extended shade position.

2. The covering of claim 1, wherein:
the retention element is movable between a first position and a second position;
when in the first position, the retention element maintains the preload in the biasing element; and
when in the second position, the retention element releases the preload in the biasing element.

3. The covering of claim 2, wherein the assembly further comprises a rotatably-fixed anchor.

4. The covering of claim 3, wherein:
when in the first position, the retention element engages the anchor to restrain movement of the biasing element; and
when in the second position, the retention element disengages the anchor to permit movement of the biasing element.

5. The covering of claim 1, wherein the biasing element is a torsion spring.

6. The covering of claim 1, wherein the retention element is pivotable between a radially-inward position and a radially-outward position.

7. The covering of claim 6, wherein the assembly further comprises a translatable nut configured to move the retention element from the radially-inward position to the radially-outward position upon the shade reaching the extended shade position.

8. The covering of claim 1, wherein the extended shade position comprises a fully extended, closed shade position.

9. The covering of claim 1, wherein:
the shade comprises two sheets interconnected by a plurality of vanes; and
the assembly is configured to rotate the roller a supplemental amount that laterally separates the sheets and moves the plurality of vanes into an at least partially open position.

10. A covering for an architectural opening, the covering comprising:
a rotatable roller;
a shade suspended from the roller and wrappable about the roller; and
an assembly associated with the roller to rotate the roller a supplemental amount in an extension direction when the shade is in an extended position, the assembly comprising:
an anchor;
a preloaded biasing element having a fixed end and a movable end; and
a pawl that moves with the movable end of the preloaded biasing element, the pawl movable between a first position and a second position;
wherein:
when in the first position, the pawl engages the anchor to restrict movement of the movable end of the preloaded biasing element; and
when in the second position, the pawl disengages the anchor to free the movable end of the preloaded biasing element, thereby allowing the preloaded biasing element to rotate the roller the supplemental amount in the extension direction moving the shade from a closed position to an at least partially open position.

11. The covering of claim 10, further comprising a shaft rotatably mounted on the anchor and secured to the movable end of the preloaded biasing element.

12. The covering of claim 11, wherein the shaft defines a cavity that houses the pawl.

13. The covering of claim 12, wherein the cavity opens to the anchor and to the roller.

14. The covering of claim 10, wherein:
the anchor includes a circumferential pocket; and
the pawl is seated in the pocket when in the first position.

15. The covering of claim 11, wherein the shaft is externally-threaded, and further comprising a translatable nut threadably mounted on the shaft and keyed to the roller so that the nut rotates in unison with the roller.

16. The covering of claim 15, wherein the nut includes a cam that moves the pawl from the first position to the second position when the shade is extended to the predetermined position.

17. The covering of claim 10, wherein when in the second position, the pawl contacts and rotates the roller under the bias of the preloaded biasing element.

18. The covering of claim 17, wherein:
the roller includes an internal, longitudinally-extending rib; and
when in the second position, the pawl contacts the rib of the roller.

19. The covering of claim 10, wherein:
the shade comprises two sheets interconnected by a plurality of vanes; and
the supplemental amount of roller rotation laterally separates the sheets and moves the plurality of vanes towards a horizontal orientation.

20. A covering for an architectural opening, the covering comprising:
a rotatable roller;
a shade associated with the roller so that rotation of the roller in one direction retracts the shade and rotation of the roller in an opposite direction extends the shade; and
an assembly associated with the roller to selectively rotate the roller in the opposite direction, the assembly comprising:
a rotatably-fixed anchor;
a preloaded torsion spring having a fixed end and a movable end;
a shaft having a first section and a second section, the first section rotatably mounted on the anchor and including a cavity open to the anchor and to the roller, the second section secured to the movable end of the preloaded torsion spring; and
a pawl pivotably seated in the cavity of the first section of the shaft, the pawl pivotable between a radially-inward position and a radially-outward position;

wherein:

when in the radially-inward position, the pawl engages the anchor to limit rotation of the movable end of the preloaded torsion spring; and when in the radially-outward position, the pawl disengages the anchor and engages the roller to rotate the roller in the opposite direction under the bias of the preloaded torsion spring.

21. The covering of claim 20, further comprising a nut keyed to the roller and translatable along the second section of the shaft, the nut including a cam that moves the pawl from the radially-inward position to the radially-outward position when the shade reaches an extended position.

22. The covering of claim 1, wherein rotation of the roller does not affect the preload of the biasing element until the shade reaches the extended shade position.

23. The covering of claim 1, wherein the retention element retains the preload in the biasing element until the shade reaches the extended shade position.

24. The covering of claim 1, wherein the retention element is coupled with an end of the biasing element.

25. The covering of claim 1, wherein the retention element is positioned inside the roller.

26. A covering for an architectural opening, comprising:

a rotatable roller;

a shade suspended from the roller and wrappable about the roller; and an assembly associated with the roller to rotate the roller a supplemental amount in an extension direction when the shade is in an extended position, the assembly comprising:

an anchor;

a preloaded biasing element having a fixed end and a movable end; and a pawl associated with the movable end of the preloaded biasing element, the pawl movable between a first position and a second position;

wherein:

when in the first position, the pawl engages the anchor to restrict movement of the movable end of the preloaded biasing element; and when in the second position, the pawl disengages the anchor to free the movable end of the preloaded biasing element and the pawl contacts and rotates the roller under the bias of the preloaded biasing element, thereby allowing the preloaded biasing element to rotate the roller the supplemental amount in the extension direction moving the shade from a closed position to an at least partially open position.

27. The covering of claim 26, wherein the pawl is positioned inside the roller.

28. The covering of claim 26, wherein:

the roller includes an internal, longitudinally-extending rib; and when in the second position, the pawl contacts the rib of the roller.

* * * * *